US005470433A

United States Patent [19]

Brodersen et al.

[11] Patent Number: 5,470,433

[45] Date of Patent: Nov. 28, 1995

[54] PROCESS FOR THE DELIGNIFICATION OF CELLULOSE FIBER RAW MATERIALS USING ALCOHOL AND ALKALI

[76] Inventors: Karl-Heinz Brodersen, Lipperheidestrasse 28; Gerhard Dahlmann, Flossmannstrasse 13, both of 8000 Munich 60; Heinrich Leopold, Rottmannstrasse 3, 8000 Munich 2, all of Germany

[21] Appl. No.: 332,039

[22] Filed: Nov. 1, 1994

Related U.S. Application Data

[63] Continuation of Ser. No. 830,587, Feb. 6, 1992, abandoned.

[30] Foreign Application Priority Data

Feb. 6, 1991 [DE] Germany ..... 41 03 572.0

[51] Int. Cl.[6] ..... D21C 3/20; D21C 3/02

[52] U.S. Cl. ..... 162/77; 162/19; 162/68; 162/76; 162/90

[58] Field of Search ..... 162/77, 76, 90, 162/68, 19

[56] References Cited

U.S. PATENT DOCUMENTS

| | | | |
|---|---|---|---|
| 3,585,104 | 7/1968 | Kleinert | 162/77 |
| 4,100,016 | 7/1978 | Diebold et al. | 162/77 |
| 4,496,426 | 1/1985 | Baumeister et al. | 162/77 |

FOREIGN PATENT DOCUMENTS

| | | | |
|---|---|---|---|
| 1111694 | 11/1981 | Canada | 162/77 |
| 0012960 | 7/1980 | European Pat. Off. . | |
| 0990969 | 10/1983 | European Pat. Off. . | |

OTHER PUBLICATIONS

Green, Jesse "Alkaline Pulping in Aq. Alcohols & Amines", TAPPI, May 1982, vol. 65, No. 5, pp. 133–137.

Ed McKenna, "Displacement Impregnation in a Continuous Digester", TAPPI, May 1977, vol. 60, No. 5, pp. 102–104.

April et al., "Prehydrolysis achieves higher organosolve delig."TAPPI, Feb. 1982, vol. 65, No. 2, pp. 41–44.

April, et al., "Delignification with Aqueous Organic Solvents", TAPPI, May 1979, vol. 62, No. 5, pp. 83–85.

Williamson, Peter, "Repap's Alcell™ Process: How it works & what it offers" Pulp & Paper Canada 88: 12 (87).

*Primary Examiner*—W. Gary Jones
*Assistant Examiner*—Dean T. Nguyen
*Attorney, Agent, or Firm*—Robert J. Koch

[57] ABSTRACT

A process for the delignification of cellulose fiber plant raw material for the production of pulp using separate impregnating and delignifying stages, each using alcohol and alkali. The process may be carried out in batch or in a continuous process. Less alcohol is used in the delignification stage than in the delignification stage. The pulp produced has very good properties because different amounts of alcohol are being used in the impregnation stage and in the delignification stage.

32 Claims, 3 Drawing Sheets

PROCESS FOR THE DELIGNIFICATION OF CELLULOSE FIBER RAW MATERIALS USING ALCOHOL AND ALKALI

This is a continuation of application Ser. No. 07/830,587, filed Feb. 6, 1992.

BACKGROUND OF THE INVENTION

1. Field of the Invention

The invention is concerned with a process for the delignification of cellulose fiber raw materials, specifically wood chips, using alcohol.

2. Description of the Related Technology

In the search for environmentally benign processes for the production of pulp, the so-called organosolv processes have increasingly gained interest. Organosolv processes are those in which alcohol is used for the purpose of delignification of the fiber raw materials. These processes do not use sulfur compounds which are today's dominant pulping chemicals.

In the most commonly used process today, the Kraft process, sulfide is used which causes environmentally unacceptable air emissions. It is also the cause of nuisance due to odor.

The sulfite process is somewhat easier to control than the Kraft process; however, the fiber properties of sulfite pulps are inferior to Kraft pulps.

The organosolv process, using a mixture of water and alcohol (e.g., EU PS0090969), made it possible to produce pulps of acceptable quality without the disadvantages of the sulfur compounds.

Pulps of very good fiber properties were produced by means of a two-stage process in which the wood chips were first cooked in a mixture of alcohol and water under acid conditions, to be followed by a second stage in which sodium hydroxide and alcohol were added to the aqueous alcohol solution and the cook continued under alkaline conditions. Prior to the cooking stages was a separate impregnation stage in which the wood chips were first pre-steamed and subsequently impregnated at low temperature with an aqueous alcohol solution.

It was also proposed to pulp cellulose fiber raw material with alcohol together with sodium hydroxide. Trial cooks in batch digesters showed, however, that the delignification of the fiber raw material was unsatisfactory and the KAPPA numbers of the pulps obtained were quite high despite long cooking times.

SUMMARY OF THE INVENTION

Research on the Organosolv Process quite surprisingly has shown that a satisfactory delignification is possible and pulp of superior quality can be obtained when the process is split up into an impregnation stage and a delignification stage and when the amount of alcohol applied is less in the delignification stage than in the impregnation stage. These results were not expected. The pulp so produced has quality characteristics equal to Kraft pulps and can be used for the production of high-quality paper. In the process it is of utmost importance that the wood chips are thoroughly impregnated with alcohol and the wood substance is therefore protected from the action of the alkali in the delignification stage. The impregnation of the wood with the alcohol results in a uniform delignification throughout the overall reaction time, with very little lignin condensation. The lignin is dissolved out of the wood substance with very little fiber damage. It is necessary to reduce the alcohol concentration in the delignification stage compared to the impregnation stage in order not to retard the delignification.

In the process, the cellulose fiber material is impregnated with pure alcohol or an alcohol/water mixture which may be either at an elevated temperature or heated to an elevated temperature. The choice of using pure alcohol or an alcohol/water mixture depends on the moisture content of the cellulose fiber material and the desired liquid-to-wood ratio. As a rule, a low liquid-to-wood ratio is desirable.

The cellulose fiber material is left in the impregnation liquor until there is a phase equilibrium between the moisture in the fiber material and the impregnation liquor. Following the impregnation, the cellulose fiber material is delignified with a mixture of alkali, alcohol and water which either is at an elevated temperature or is heated to an elevated temperature.

The amount of the mixture of alkali, alcohol and water used in the delignification stage depends on the type of cooking process, either a continuous process or a batch process and, in particular, on the amount of liquid charged from the impregnation stage.

In a continuous process an alkali-water mixture is constantly added to the delignification stage.

The delignification process is carried out in such a way that the amount of alcohol contained in the cellulose fiber material constantly decreases while the amount of alkali in the cellulose fiber material initially increases and then decreases until a phase equilibrium has been reached.

In a batch process, the impregnation and the delignification processes can be carried out in the same reaction vessel, one after the other, that is to say, the cellulose fiber material is first added to the reaction vessel and the impregnation of the material is carried out first with the alcohol-water mixture. Then, delignification follows with the addition of the alkali-water mixture.

In the preferred method, however, the impregnation liquor is first withdrawn from the reaction vessel. Then the liquor for delignification is charged to the reaction vessel. By this method the amount of alkali used in the process can be greatly reduced.

In a continuous process, the impregnation of the cellulose fiber material is carried out in two separate steps in either the same or in two separate vessels. While in a batch process only the liquid is moved, in a continuous process both the liquids and the cellulose fiber material are moved.

The amount of (aqueous) alcohol charged to the cellulose fiber material is chosen such that the concentration of alcohol in the impregnation liquor is in the range 30–60% by weight, preferably 40–50% by weight. The cellulose fiber material, when charged to the reaction vessel, may contain a substantial amount of water, depending on its moisture content. It is necessary to select an appropriate alcohol concentration in order to obtain the phase equilibrium in the impregnation stage; this may mean that the concentration of the alcohol in the impregnation liquor may initially and for a short period of time be higher than may be desirable for the entire process. Because of the propensity of the alcohol to penetrate the wood chips, however, the phase equilibrium is very rapidly achieved.

For this process it is advantageous, however, to have a very high alcohol concentration in order to speed up the penetration of the alcohol into the wood chips.

The delignification following the impregnation is to be carried out with a lower alcohol concentration in the delignification liquor than in the impregnation liquor in order to prevent a delay of the delignification due to a high alcohol concentration. It is of advantage when the alcohol concentration is in the range of 20–40% by weight, preferably 20–30% by weight, based on the delignification liquor. The concentration of alkali on OD fiber material should be in the range of 12–25% by weight, specifically 18–20% by weight for softwoods and 14–18% by weight for hardwoods.

Methanol or ethanol can be used for alcohols. These are the preferred alcohols because of their low boiling points and their low specific heat contents.

A sodium hydroxide solution is used for alkali. The impregnation liquor has a temperature of 100°–160° C., preferably 110°–130° C., and is chosen such that impregnation proceeds rapidly without a noticeable delignification. The temperature of the liquor for delignification is set depending on the type of cellulose fiber material picked. The temperature is in the range 150°–190° C., preferably 160°–175° C. Easy to pulp cellulose fiber materials are cooked at a low temperature while hard to pulp fiber materials are cooked at higher temperatures.

The time for impregnation is in the range 30–120 minutes, preferably 60 minutes. The time for delignification is somewhat longer, in the range 100–300 minutes, preferably 150 minutes.

In a batch process, the heating-up of the impregnation liquor and the delignification liquor is carried out indirectly by means of a heat exchanger, which is to say, the same heat exchanger may be used for the impregnation as well as for delignification. For a continuous process two separate heat exchangers may be used for heating of the impregnation liquor and for the delignification liquor.

In a continuous process it is advantageous for the cellulose fiber material to be charged together with the liquor. To accomplish this, a portion of the impregnation liquor is constantly withdrawn at the end of the impregnation stage, heated in the heat exchanger and then added again to new cellulose fiber material being charged into the impregnation stage.

The liquid-to-wood ratio in the delignification stage is in the range 3.5:1 to 5:1, preferably 4.5:1.

In the process described above, the pH in the impregnation stage is in the range pH 4–6. The pH in the delignification stage is in the range 9–12. The process can be improved upon, however, by also charging a small amount of alkali in the impregnation stage.

Experiments have shown that pulps of very good quality have been obtained when 2–12% alkali, based on OD wood material, is added in the impregnation stage so that the pH in the impregnation stage is in the range of 7–12. It is important, however, that the amount of alkali charged in the impregnation stage is less than that charged in the delignification stage.

In a continuous process, ideal operating conditions exist when the liquors and the cellulose fiber material flow concurrently. At the end of the delignification stage, the liquor is withdrawn and sent to an alcohol recovery plant in which the alcohol is concentrated to 95% by weight. The delignification liquor is heated by means of the alkali-water mixture which is added with the impregnation liquor coming from the end of the impregnation stage.

In the alcohol recovery plant it is possible to recover the alcohol to a high concentration, however, a concentration of 95% by weight normally is sufficient for adjusting the impregnation liquor. Following the delignification stage, the cellulose fiber material, which has become pulp, is washed counter-currently in order to remove the residual alcohol and alkali.

With some wood species it may be desirable to add anthraquinone in an amount of 0.01–0.15% based on OD wood in order to improve the degree of delignification.

It may be advantageous for the process if the cellulose fiber material is presteamed prior to impregnation. Upon steaming, air is expelled from the cellulose fiber material, thus aiding in the impregnation with the alcohol. Steaming can be done with water vapor and/or with alcohol vapor.

BRIEF DESCRIPTION OF THE DRAWINGS

The following examples explain the process.

DESCRIPTION OF THE PREFERRED EMBODIMENTS OF THE INVENTION

Figure 1:
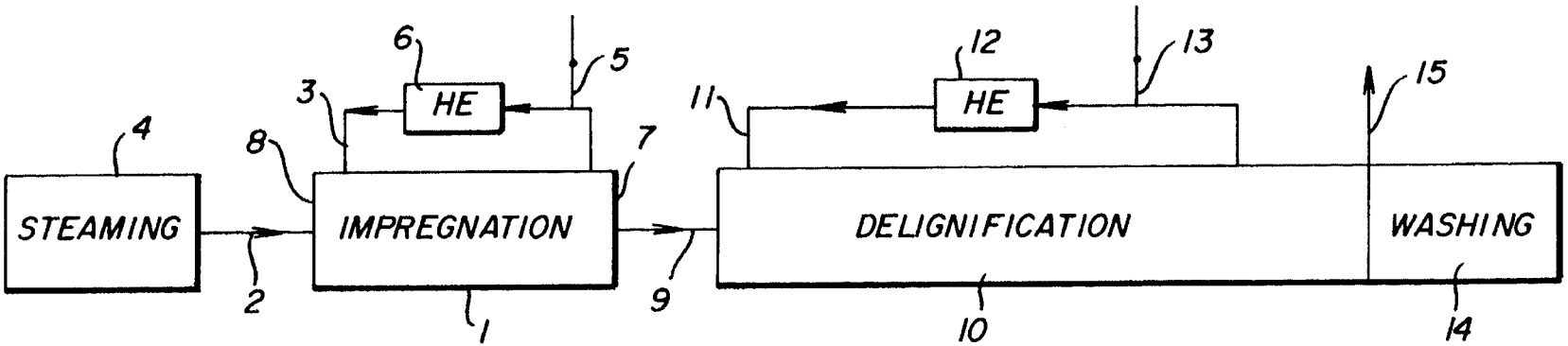
FIG. 1 is a block diagram of the process.

Cellulose fiber material with a typical moisture content is charged by means of a feeder line 2 via a feeder, not shown in the block diagram, into the impregnation vessel 1. In a continuous process, loading of the wet cellulose fiber raw material into the impregnation vessel 1 is carried out simultaneously with the addition of the impregnation liquor via line 2. In a batch process, the impregnation liquor is added via line 3 following the loading of the cellulose fiber raw material into the reactor vessel.

The cellulose fiber material has previously been steamed with water vapor in the steaming vessel 4 and is at a temperature of about 100° C. when it reaches the impregnation stage 1. Air is removed from the wood chips during steaming.

Alcohol is added to the impregnation stage via line 5, coming from the alcohol recovery plant which is not shown for the sake of simplicity. The alcohol has a concentration of 95% by weight, the remaining 5% are water.

Figure 2:
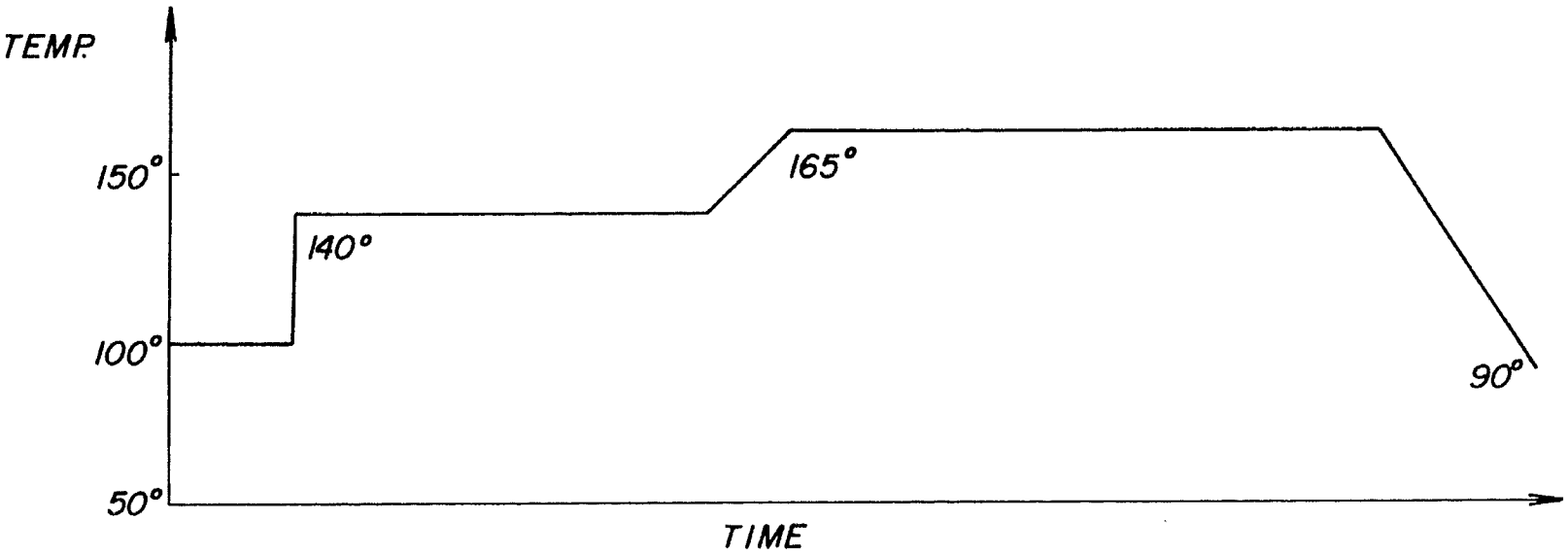
FIG. 2 is a trace of the temperature profile in the course of the process.

In the impregnation vessel 1 the liquor and the cellulose fiber material are heated within a very short period of time from 100° C. to 140° C., see FIG. 2. Heat exchanger 6 is used for heating of the impregnation liquor. At the far end 7 of the impregnation vessel 1 a portion of the impregnation liquor is withdrawn, pumped to the heat exchanger 6 and then pumped to the feeder 8 of the impregnation stage 1.

The temperature and the concentration of the alcohol in the impregnation liquor are maintained at a constant level throughout this process.

Figure 3:
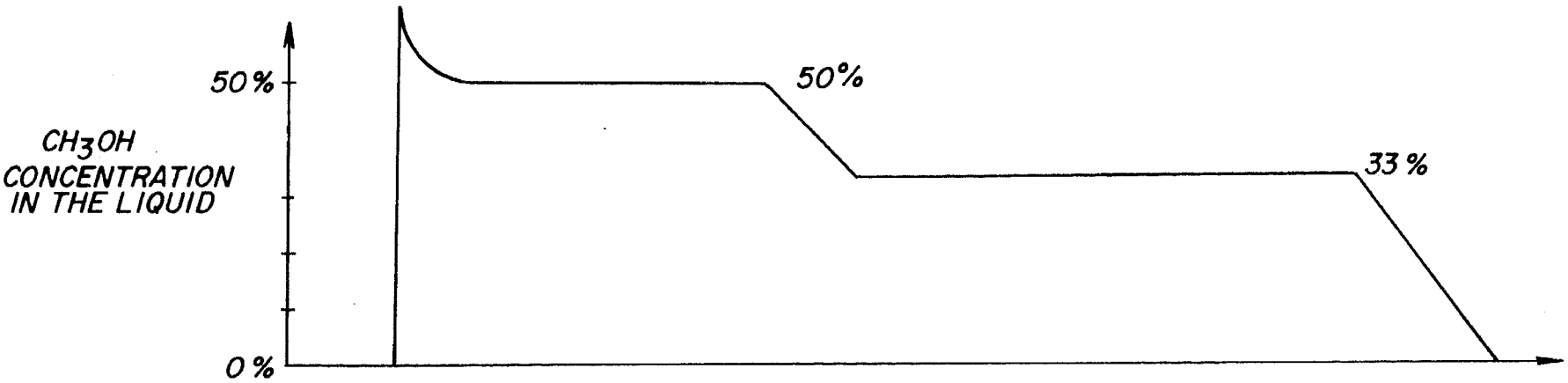
FIG. 3 is a trace of the alcohol concentration in the liquors in the process.

The concentration of the alcohol in the impregnation liquor will stay at a constant level during the time period for impregnation. Only at the beginning of the impregnation period there is a somewhat higher concentration, as see in FIG. 3.

There is a steady increase in the concentration of the alcohol in the fiber material until there is a phase equilibrium towards the end of the impregnation period.

Following impregnation, the cellulose fiber material together with a predetermined amount of impregnation liquor, consisting of alcohol and water, are taken to the delignification vessel 10 via line 9. A mixture of water and alkali are added in the delignification vessel 10 via line 11. The cellulose fiber material and the delignification liquor are heated very rapidly in the delignification vessel 10 from 140° C. to 165° C. Heating of the delignification liquor is done by means of heat exchanger 12.

The addition of the alkali, together with the heating, results in a reduction of the alcohol concentration in the delignification vessel 10 and commencement of the delignification process. In the present example, the concentration of the alcohol is reduced over a very short period of time from 50% by weight to 33% by weight, but then stays constant.

Figure 4:
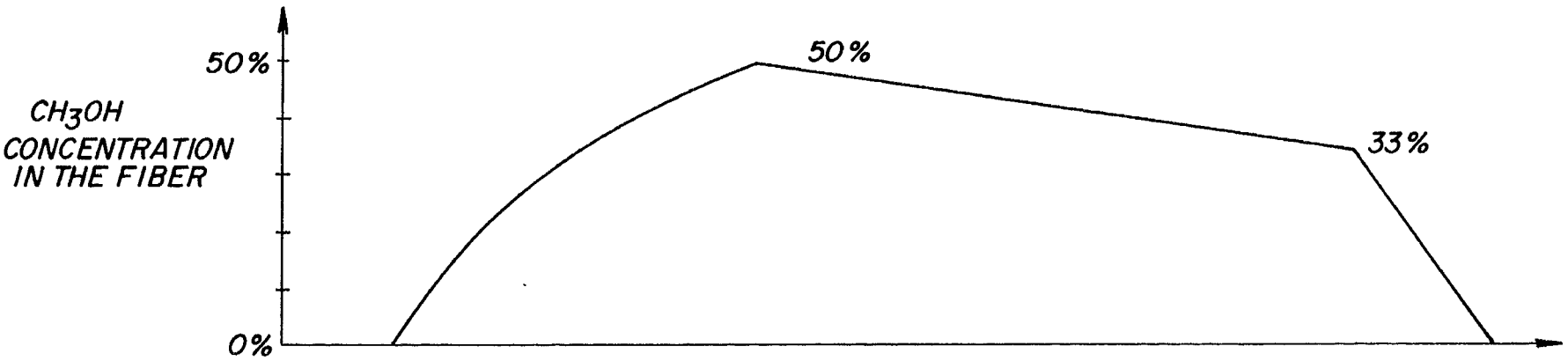
FIG. 4 is a trace of the course of the alcohol concentration in the fiber material.

The concentration of the alcohol in the wood chips, however, steadily decreases at a constant rate throughout the delignification stage until a phase equilibrium has been reached again at 33% by weight, FIG. 4.

Figure 5:
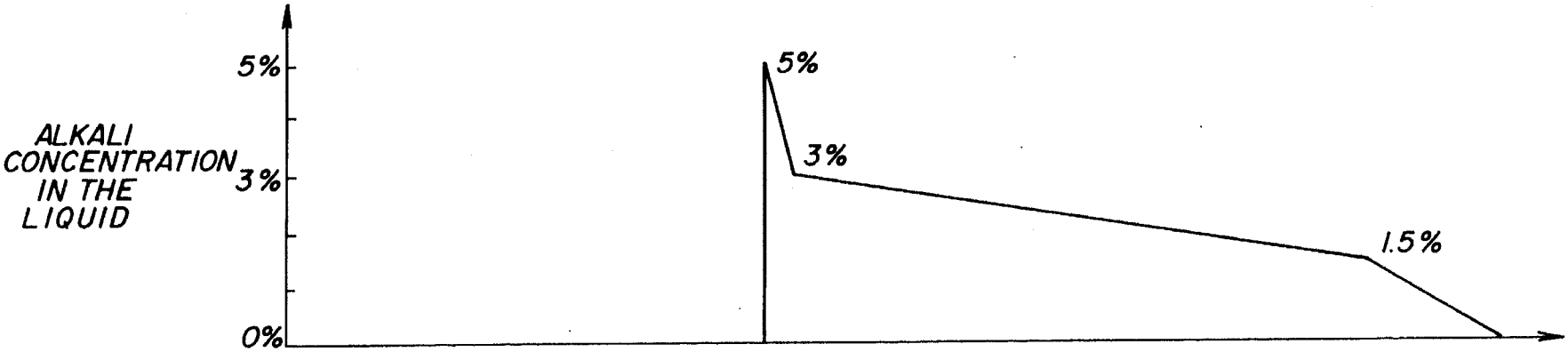
FIG. 5 is a trace of the alkali concentration in the liquors.
Figure 6:
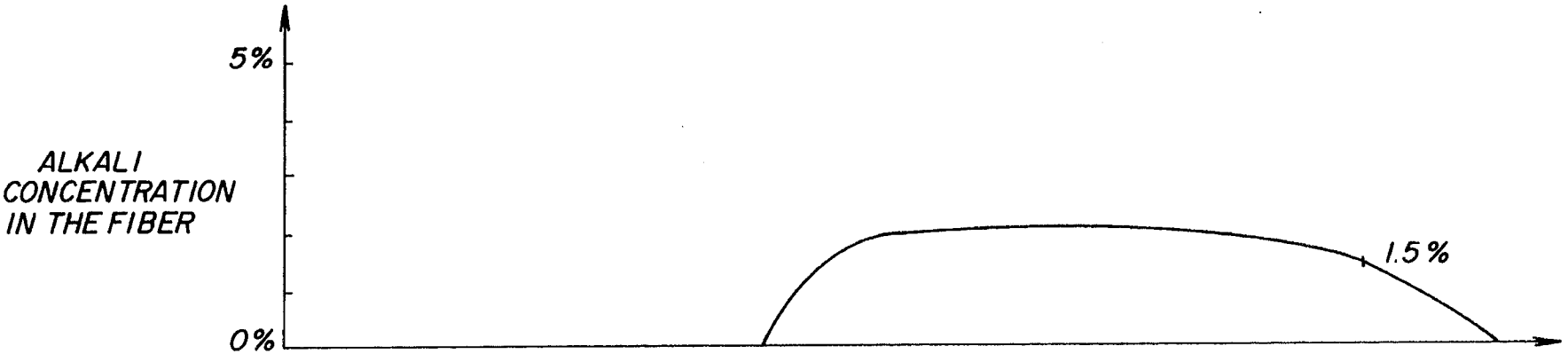
FIG. 6 is a trace of the alkali concentration in the fiber material.

The concentration of the alkali charged, FIG. 5, is reduced from 5% to 3% very rapidly due to mixing with the liquid from the impregnation stage and then steadily decreases to a concentration of 1.5%. The alkali, on the other hand, similarly penetrates the woody material in a constant manner as seen in FIG. 6. A phase equilibrium will be reached at a concentration of 1.5%. Delignification then stops.

The alkali used up during the delignification is made up by the addition of alkali coming from the chemicals recovery plant via line 13.

Following delignification there is a washing stage 14 in order to remove residual alcohol and alkali from the pulp.

This invention does not concern itself with the subsequent unit operations like screening and bleaching as these are conventional processes.

The diagrams essentially describe the course of temperatures and chemicals concentrations. It is understood that depending on the type of cellulose fiber raw material used, deviations in the amounts of alcohol and alkali may occur, however, the shapes of the curves stay the same.

In the washing stage 14 alkali and alcohol are washed out of the pulp and taken together with the wash liquor to the chemicals recovery plant. The delignification liquor is withdrawn via line 15 and sent to the alcohol recovery plant and evaporation plant.

What is claimed is:

1. A process for the delignification of fibrous material comprising:

heating a mixture of alcohol and water, contacting the fibrous material with impregnation liquor at a temperature in the range of 100°–160° C. in an impregnation stage comprising the addition of said heated mixture of alcohol and water, impregnating the fibrous material in the impregnation stage until a phase equilibrium is attained between the impregnation liquor and the liquid contained in the fibrous material, heating an aqueous mixture of alkali and alcohol, contacting the fibrous material with delignifying liquor in a single delignification stage comprising the addition of said heated aqueous mixture of alkali and alcohol, wherein the concentration of alcohol in the delignification stage is lower than the concentration of alcohol in the impregnation stage, and the pH in the delignification stage is in the range pH 9–12;

decreasing uniformly the concentration of alcohol contained in the fibrous material during the delignification stage, and steadily increasing the concentration of the alkali in the fibrous material during the initial delignification stage, and then decreasing the concentration of alkali until a phase equilibrium is again reached between the liquid in the fibrous material and the delignification liquor.

2. A process according to claim 1 further comprising carrying out the impregnation stage and the delignification stage, one after the other, in the same reaction vessel.

3. A process according to claim 1 further comprising carrying out the impregnation stage and the delignification stage, one after the other, in two separate reaction vessels.

4. A process according to claim 1 wherein the concentration of the alcohol in the aqueous impregnation liquor is 30–60% by weight.

5. A process according to claim 4 wherein the concentration of the alcohol in the aqueous impregnation liquor is 40–50% by weight.

6. A process according to claim 1 wherein the delignification liquor has an alcohol concentration of 20–40% by weight.

7. A process according to claim 1 wherein the delignification liquor has an alcohol concentration of 25–30% by weight, based on the total liquor weight.

8. A process according to claim 1 wherein the delignification liquor has an alkali concentration of 12–5% by weight.

9. A process according to claim 8 wherein the delignification liquor has an alkali concentration of 18–20% by weight for softwoods.

10. A process according to claim 8 wherein the delignification liquor has an alkali concentration of 14–18% by weight for hardwoods, based on OD fibrous material.

11. A process according to claim 1 wherein the alcohol used may be methanol or ethanol.

12. A process according to claim 1 in which the alkali used is a sodium hydroxide solution.

13. A process according to claim 1 in which the temperature of the impregnation liquor is in the range 100°–130° C.

14. A process according to claim 1 in which the temperature of the delignification liquor is in the range of 150°–190° C.

15. A process according to claim 14 in which the temperature of the delignification liquor is in the range 160°–175° C.

16. A process according to claim 15 wherein only steam alone or steam and alcohol vapor are used in pre-steaming.

17. A process according to claim 1 wherein the impregnation stage is allowed to proceed for 30–120 minutes.

18. A process according to claim 17 wherein the impregnation stage is allowed to proceed for 60 minutes.

19. A process according to claim 1 wherein the delignification stage is allowed to proceed for 100–300 minutes.

20. A process according to claim 19 wherein the delignification stage is allowed to proceed for 150 minutes.

21. A process according to claim 1 wherein the impregnation liquor and the delignification liquor are heated indirectly in a separate liquor heating cycles.

22. A process according to claim 1 wherein the liquor-to-wood ratio in the impregnation stage is in the range 2:1 to 3.5:1.

23. A process according to claim 22 wherein the liquor-to-wood ratio in the impregnation stage is 2.2:1.

24. A process according to claim 1 in which the liquor-to-wood ratio in the delignification stage is in the range 3.5:1 to 5:1.

25. A process according to claim 31 in which the liquor-to-wood ratio in the delignification stage is 4.5:1.

26. A process according to claim 1 further comprising maintaining the pH in the impregnation stage in the range of 4–6.

27. A process according to claim 1 further comprising adding 2–12% alkali based on OD wood to the impregnation stage so that the pH in the impregnation stage is in the range pH 7–12.

28. A process according to claim 1 wherein the delignification liquor and the fiberous material pass concurrently through a delignification vessel.

29. A process according to claim 28 wherein the delignification liquor is withdrawn from the delignification vessel and sent to an alcohol recovery plant where the alcohol is concentrated up to 95% by weight.

30. A process according to claim 1 in which the fiber material is washed countercurrently following the delignification stage.

31. A process according to claim 1 further comprising the addition of anthraquinone in a concentration of 0.01 to 0.15% by weight based on 0D wood.

32. A process according to claim 1 further comprising pre-steaming the fiber material prior to impregnation.

* * * * *